United States Patent [19]

Hoyeck

[11] Patent Number: 5,026,095

[45] Date of Patent: Jun. 25, 1991

[54] PERPETUAL BLIND CALENDARS SERIES 2

[76] Inventor: Ralph H. Hoyeck, 80 Somerville, Westmount, Quebec, Canada, H3Z 1J5

[21] Appl. No.: 526,539

[22] Filed: May 22, 1990

Related U.S. Application Data

[63] Continuation of Ser. No. 303,930, Jan. 30, 1987, abandoned.

[30] Foreign Application Priority Data

Apr. 20, 1988 [CA] Canada ..... 564569

[51] Int. Cl.[5] ..... B42D 15/00

[52] U.S. Cl. ..... 283/2; 283/117

[58] Field of Search ..... 283/2, 3, 4, 117

[56] References Cited

U.S. PATENT DOCUMENTS

| | | | |
|---|---|---|---|
| 1,233,447 | 7/1917 | Carpenter | 180/72 |
| 1,608,411 | 11/1926 | Mateju | 283/2 |
| 3,514,884 | 6/1970 | Passariello | 283/2 |
| 3,605,307 | 9/1971 | Dickson | 283/2 |
| 4,251,935 | 2/1981 | Wright | 283/2 |
| 4,285,148 | 8/1981 | Kolar | 283/2 X |
| 4,793,634 | 12/1988 | Alloggiamento | 283/2 |
| 4,813,707 | 3/1989 | Habib | 283/2 |
| 4,828,290 | 5/1980 | Harris | 283/2 |

*Primary Examiner*—Paul A. Bell

*Attorney, Agent, or Firm*—Maritide Co. Ltd

[57] ABSTRACT

The present invention deals with a variety of advanced perpetual calendars, combined calendars, multiple calendars.

17 Claims, 8 Drawing Sheets

PERPETUAL BLIND CALENDARS SERIES 2

This is a continuation of application Ser. No. 07/303,930 filed 01/30/89 now abandoned.

The present invention is titled perpetual blind calendars, series 2 abbreviated as (PBC2) and deals with a variety of advanced, and improved perpetual calendars, and combined calendars using basically two or more units with at least one unit mobile with respect to the others with large scale displays using common variable symbols of One Letter Alphabet (OLA) system.

Comparison with the prior art revealed no substantial prior art in that field that could replace the present invention.

FIELD OF THE INVENTION

The present invention is an improvement to the previous U.S. Pat. No. 1,233,447 and deals with a variety of advanced and improved perpetual calendars using; a) calendars with 3 units, mobile with respect to each other, with one unit representing the weekdays, one unit representing January and February and one unit representing the remaining ten months of the year March to December, b) calendars with 2 units one representing the weekdays on a belt mounted on the second unit representing the twelve months of the year, c) calendars using weekdays represented on belts and other belt or belts representing the twelve months of the year, d) calendars made of concentric transparent tubes, one representing the weekdays and the other representing the twelve months of the year, e) circular calendars using one ring or disc to display the weekdays and another to display the twelve months of the year, f) short moon calendars using a plurality of belts one to represent the weekdays and others to represent groups of the months of the year, g) combined calendars combining gregorian calendars with short, moon calendars, biblical calendars, chinese calendars, etc., h) monthly calendars comprising a minimum of 2 parts, one mobile with respect to the other with one part representing the weekdays on a mobile strip or continuous belt and another part representing the days of the month, usually on five parallel rows, etc. i) weekly/daily planning calendars with a roll of transparent paper spread over the marking of the said calendars and unrolling to another pin on the opposite side, j) dual and multiple calendars using a yearly calendar together with a monthly calendar and a weekly/daily planning calendar, k) multiple circular yearly/monthly calendars with pulleys, gears, sprockets, etc., connected with belts, chains or the like rotating altogether with manual or motorized operation, etc., with cursors to pinpoint the actual weekday and its date and with large scale display of the weekday and its date by means of coloured, luminous or physical displays using common variable symbols based on the One Letter Alphabet (OLA) system, that could be visually read at a distance and could be sensed by the blind by touching process.

PRIOR ART

The prior art uses mainly disposable calendars hinging basically around the seven days weekly unit and since the number of days in the months differs from one month to the other, and since said numbers are not divisible by seven, it makes it difficult but not impossible to produce re-usable calendars hinging on the seven days weekly unit.

Several attempts were made in the past to produce permanent calendars but failed to come up with a satisfactory permanent calendar in relation to the mechanisms, positioning of the units, displays of information, and the overall costs, to replace the present calendars, taking into account that the calendars in use allow the user to write notes and appointments next to the dates while using the calendars.

On the other hand a calendar hinging around the monthly unit results with very small figures hard to distinguish on a distant wall calendar.

At the same time, the species of the art disclosed in U.S. Pat. No. 1,233,447 had to be further detailed and clarified.

Such are the problems that the present invention tries to solve to create perpetual calendars, practical to use and easy to produce.

SUMMARY

The present invention deals with perpetual, single, multiple, solar gregorian and moon calendars, with yearly, monthly calendars combined with weekly/daily agendas, with numbered weekdays and months in rectangular, tubular or circular shapes, etc.; a) with yearly and monthly calendars comprising a minimum of two units, one mobile with respect to the other and with one representing the weekdays and the other representing the year or the month, displayed on flat strips, on continuous belts, on circular discs or rings, etc., with surface laminated or superimposed transparent disposable or erasable papers, films or the like, for writing notes, appointments, etc., over the appropriate dates, b) with weekly/daily planning calendars marked on the main board with superimposed transparent disposable or erasable paper unrolling from one roll and rolling into another on the opposite sides of the calendar, c) with multi calendars using yearly, monthly and weekly/daily agendas made compact and mounted on the same board with cursors and a large display of the actual day and its date by means of a common variable symbol using the One Letter Alphabet (OLA) system, resulting in a multi calendar unit, displaying the year, the month, the week and at different scales with provisions for writing notes and planning the week ahead all on the same unit.

PREFERRED EMBODIMENTS

Figure 1:
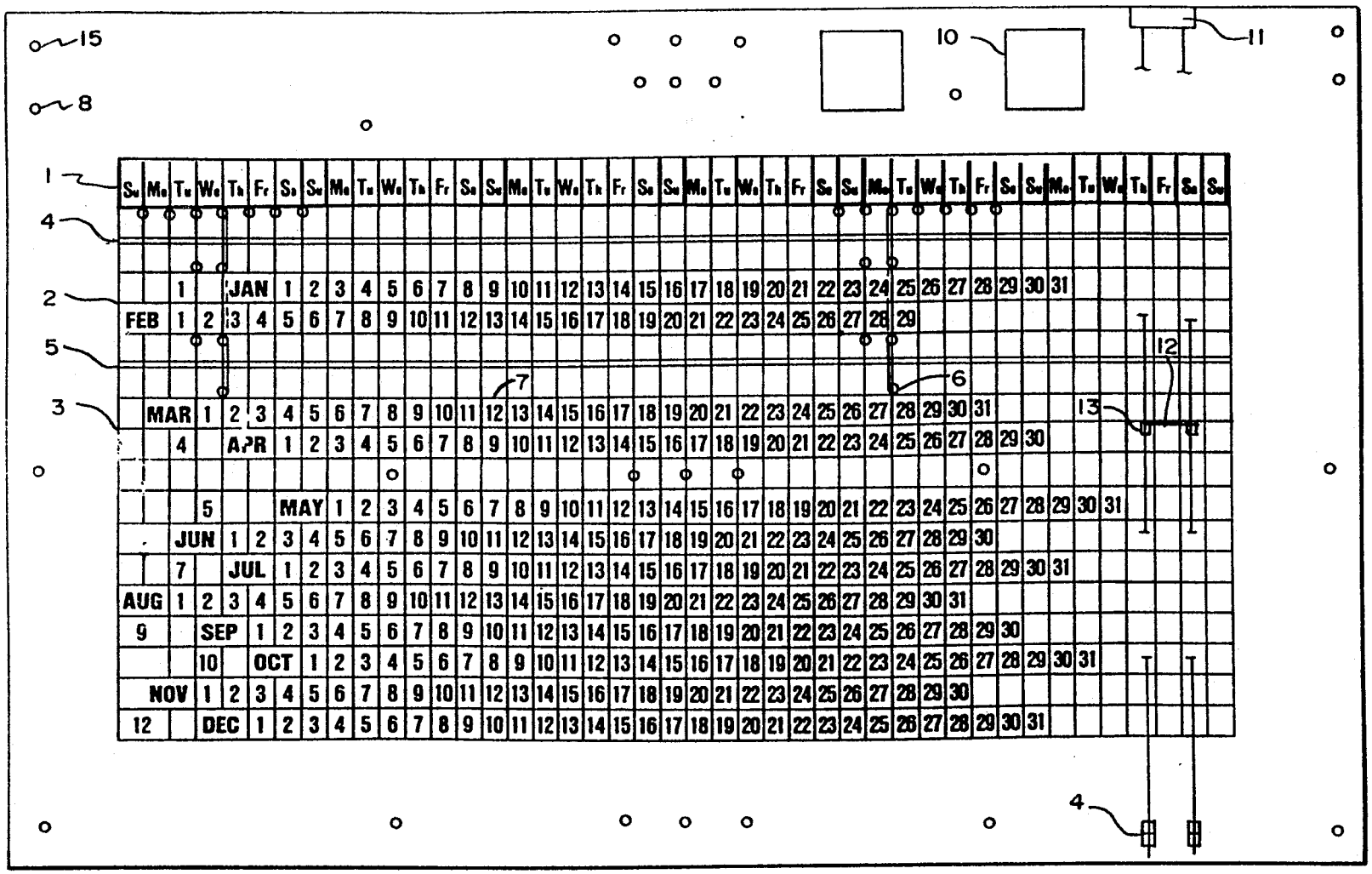
FIG. 1 —Shows a perpetual calendar made of three sections placed parallel to each other.

The present invention called the Perpetual Blind Calendar Series 2 and abbreviated as (PBC2) deals with a variety of improved and advanced perpetual calendars and related issues, described hereinafter as follows:

See FIG. 1

FIG. 1 shows a three parallel piece calendar comprising:

A. A strip No. 1, displaying a number of consecutive weekdays equal to the number of days in the longest month in the calendar system under consideration plus 12.

For the gregorian calendar, the number of consecutive weekdays for rectangular calendars is generally thirty one plus twelve equals forty three.

Said consecutive weekdays occupy the same number of equal divisions.

B. A strip No. 2, showing the month of January and the month of February placed in their constant relation with respect to the weekdays, along two parallel rows representing; the month of January with 1 to 31 consecutive numbers and the month of February with 1 to 29 consecutive numbers occupying the same number of equal divisions, having the same width of the weekdays divisions shown in No. 1.

C. Ten rows, No. 3 showing the remaining 10 months of the year placed parallel to each other in the same constant position to each other with relation to the weekdays.

The three sections of the calendar are separated at the separation lines No. 4.

At the same time the three sections of the calendar are generally provided with holes, holding points or the like, like No. 5. A tie like No. 6, is passed through certain calculated holes to join the three sections in their desired position with relation to the weekdays and to each other.

To reset the calendar:

A. For years where the 12 months keep the same number of days as in the previous year, the tie No. 6 is detached from the weekdays section and moved left or right to be connected to different holes on the weekdays section, to have the first of January, under the first week and in line with the weekday on which it begins, and the remaining 11 months of the year would automatically fall in place with relation to the weekdays.

B. For years where the number of days in one or more months is changed from the previous year, the same operation described in (A) has to be repeated after every variable month.

For the Gregorian calendar, such calendar has to be reset after the month of February, to have the first of March in line with the correct weekday on which it begins.

The present calendar shown in FIG. 1, is made of three sections to allow the re-setting of the 12 months in one operation at the beginning of the year.

For leap years and the following years, the tie No. 6, is detached from both sections No. 1 and No. 2, and re-attached through different holes on both sections to have January and March fall in the right alignment with regard to the weekdays and the remaining months of the year would automatically fall in place with relation to the weekdays.

A cursor like No. 9, is mounted on a rail over the weekdays and stretches to the end of the 12 months, to indicate the current weekday and its date.

The current weekday is seen in between the strings of the said cursor and its date on the row representing the current month, underlined by an indicator mounted in between the strings of the said cursor.

Everyday the said cursor is slid by one day's division to show the new day and its date.

Every month the months indicator is slid in between the cursor strings to underline the following month.

The calendar is provided also with holding points like No. 7, made in the form of holes, horse shoes, pins or the like, to be used as holding points for coloured cords or strings like No. 8, (see FIG. 2A) spread in between the said holding points to display the actual date at the largest scale possible.

The upper edge of the calendar is provided with hanging holes, holding points, etc., at the opposite far ends keeping the central part of the top edge free, for the operation of the cursor.

Figure 2:
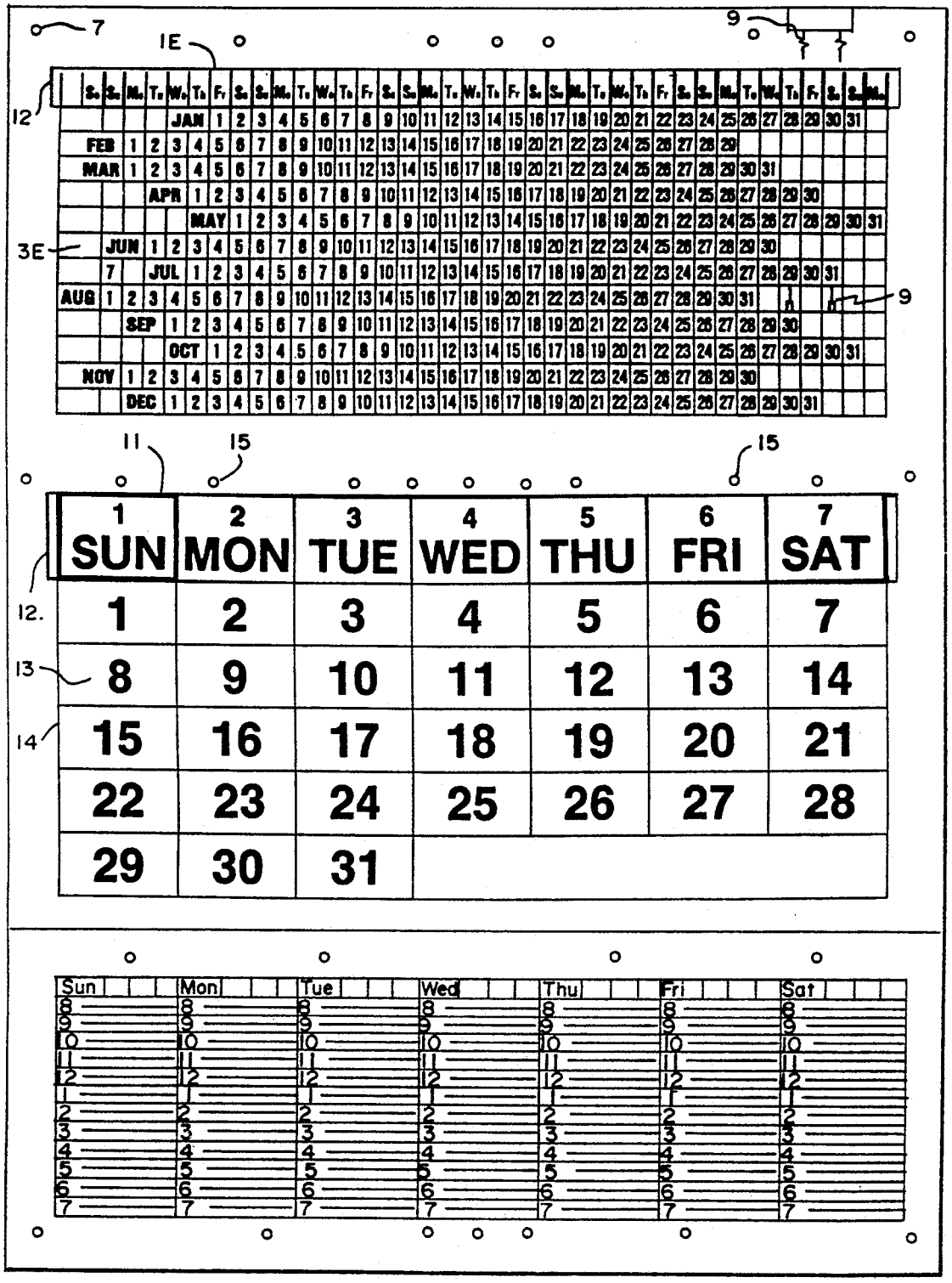
FIG. 2 —Shows a rectangular multi perpetual calendar; a yearly calendar, a monthly calendar, and a weekly/daily agenda.
Figure 2A:
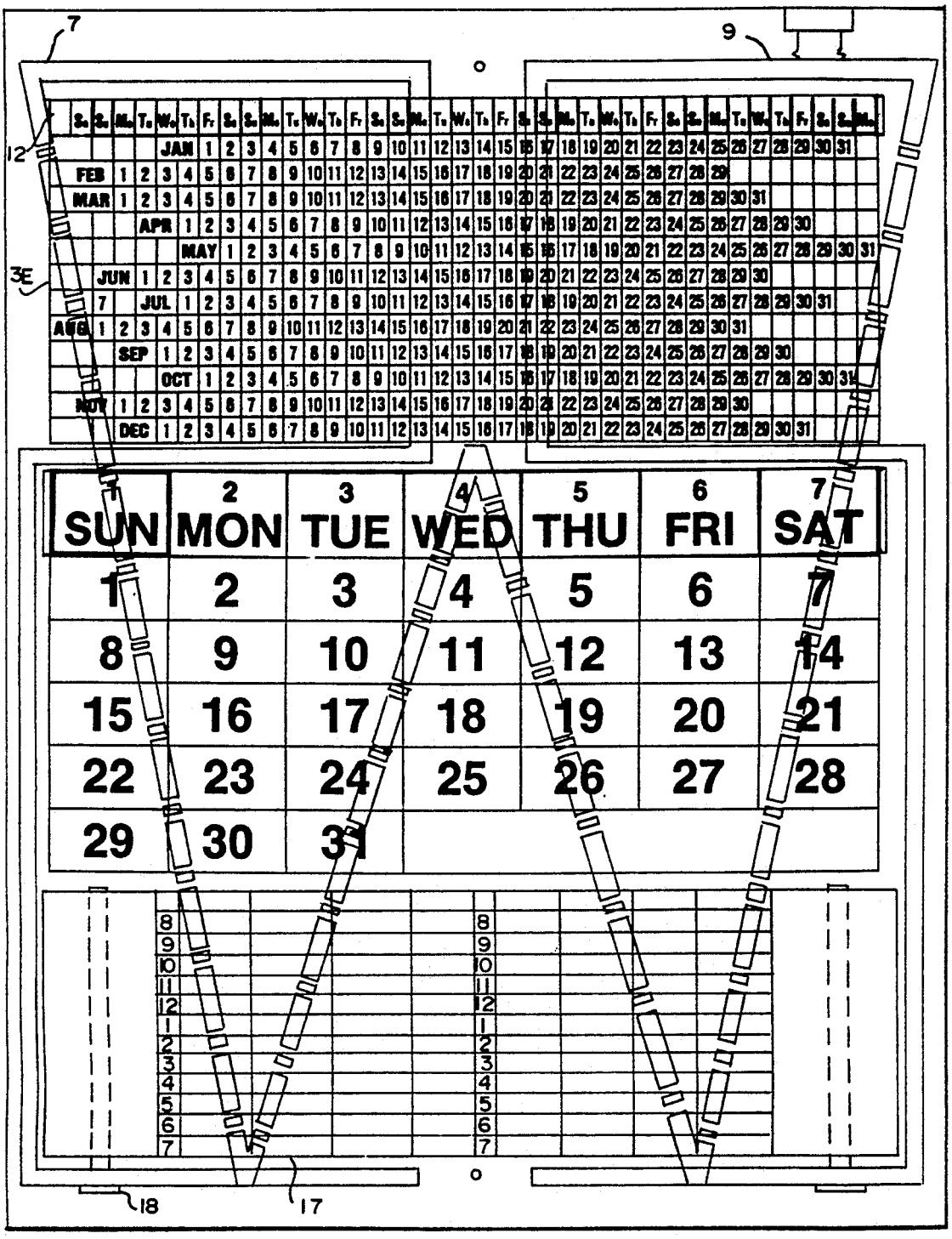
FIG. 2A —Is the same as FIG. 2, with large displays of the weekday and its date using One Letter Alphabet (OLA) system.

See FIG. 2

FIG. 2 shows a perpetual calendar comprising two main sections:

A. A strip No. 1*a* showing the same number of consecutive weekdays as in FIG. 1, occupying the same number of equal divisions. Said strip is made in the form of a continuous belt, folded around, in the present case of the Gregorian calendar, at the opposite edges of 37 divisions of the same size as the weekdays divisions, through opposite slots like No. 12.

B. A section No. 3*a* parallel to the weekdays strip, marked with the 12 consecutive months of the year placed in parallel rows and in the usual constant position with relation to each other, based on consecutive non-leap years where all the months of the year keep the same number of days as in the previous year.

To set the calendar:

A. For non-leap years, the weekdays strip is pulled to have the 1st of January come in the zone of the first or second week of the row and in line with the weekday on which it begins, and the remaining eleven months of the year would automatically fall in place with relation to the weekdays.

B. For leap years, where the number cf days in the month of February is different from the previous year, the same resetting operation should be repeated at the end of February, to have the 1st of March in line with the weekday on which it begins, and the following months will automatically fall in place with regard to the weekdays.

The calendar is provided with a cursor like No. 9, and with holding points like No. 7, for the display of the actual weekday and its date at the largest scale possible.

At the same time, to display the actual month at a large scale, the calendar is provided with:

A. A second strip of large scale weekdays like No. 11, having a minimum of 13 consecutive weekdays.

The said large scale weekdays strip is folded over at the opposite sides of 7 divisions, equal to the said weekdays divisions, and passed through two opposite slots like No. 12 and folds back behind the main plate to have its opposite ends joined with each other, to form a continuous belt.

B. A section like No. 13 parallel to the weekdays strip and marked with 31 consecutive numbers, 1 to 31, occupying 31 divisions equal to the weekdays divisions, and placed in parallel rows; 4 rows of 7 divisions each, and 3 additional divisions at the beginning of the fifth row.

The divisions are arbitrarily marked as if the 1st of a month of 31 days falls on a Sunday, i.e., that the 1st, the 8th, the 15th, the 22nd, and the 29th of the month are aligned, with the 1st day of the week, occupying each the 1st division of each of the 5 rows.

If the following month begins on Wednesday, the belt representing the weekdays is pulled to have Wednesday come in line with the 1st of the 31 divisions and the remaining 30 days of the month would automatically fall in place with respect to the weekdays.

To allow the user to write notes on the calendar without spoiling the face of the calendar:

A. A transparent sheet of paper like No. 14 is hung over the divisions representing the month, by means of pins like No. 15, or the like, to be used for writing notes, appointments or the like, etc., over any of the 31 divisions shown below through the transparent paper.

Such paper could be replaced each month or that they could be of durable transparent, erasable papers, mylar film or the like, that they could be wiped with water and reused month after month.

B. The same mylar film described in A or the like, is laminated over the surface of the whole calendar, resulting in one plate calendar with waterproof surface that could be marked with water soluble ink and wiped out with water to make room for a new writing every month.

C. The main calendar plate itself is made of synthetic water resistant film on which it would be possible to write with a water soluble ink and wipe it out with water without affecting the original printing of the calendar.

D. The main calendar plate is printed on the back of a transparent film, mylar or the like, leaving the front face of the calendar free for writing with water soluble ink, that could be wiped out and repeated without affecting the printing of the calendar itself.

In addition, the calendar assembly is provided with a perpetual agenda made of multi diary markings like No. 16, with writing provisions using:

A. Chassis mounted at the opposite sides of the said diary markings, to accomodate a roll of transparent paper like No. 17, on one side, unrolling to another pin like No. 18, on the opposite side with the transparent paper passing over the diary markings, to be used for daily planning, appointments, or the like, marked on the transparent paper, using the calendar marking underneath as a guideline for daily handwriting.

Every week or day the pin No. 18, is rotated to pull away the written paper and bring the new paper over the diary marking.

B. The diary marking is made on a detached board that is slipped in between the pages of a multi sheet transparent blank diary, (not shown) joined with a binder fastened on the board of the main calendar, resulting in a perpetual agenda attached to the main calendar plate.

C. A set of accordion folded transparent papers or films used as a diary that could fold and unfold again on the opposite sides in the same way as the word processor unfolds and folds the papers fed to it, to allow for easy revision of notes by unfolding the accordion papers at any time.

D. Transparent waterproof film laminated over the diary marking to allow writing with water soluble ink that could be wiped with water without affecting the surface of the calendar.

The perpetual multi calendar is presented in different shapes and sizes including:

A. A wall calendar, comprising; a yearly calendar, a monthly calendar and a weekly/daily agenda, together with a cursor to indicate the actual day and its date and holding points to display the weekday and its date at a large scale by means of coloured ties distributed in between the main holding points, along the lines of the letters or numbers to be displayed.

B. A briefcase calendar in the shape of a regular double folder, one inside the other, joined at the lower edges, with the triple calendar generally shown at the interior face of the inner folder, leaving the outer folder to protect the weekdays belts and with the whole assembly used as well to hold papers and documents in between the folds of the two folders.

C. A perpetual calendar/agenda having the weekly/-daily schedule presented at the inner face of a general type folder, of an average two folds of 9" by 12" or the like, with an additional outer fold at its left, representing generally the monthly perpetual calendar and an opposite outer fold at its right side, representing a perpetual yearly calendar or the like, with the whole assembly, folded, perforated with long slots and installed on a ring binder with blank transparent waterproof folders inserted on the binder inside the weekly/daily calendar, using the printing underneath as guides, printed only with the names of the 7 days of the week, without their dates and with the serial numbers of the weeks of the year from 2 to 52.

Every week a filled sheet is removed, inserted behind the calendar assembly and replaced in sequence with the following transparent blank folder. This allows the user to keep a record of the 52 weeks of the year and wipe them with water and re-use them for the following year.

The names of the weekdays on the transparent blank folder, representing the first week of the year are handwritten yearly and placed in their proper place ending with the weekday preceding the first day shown on the transparent folder representing the second week of the year.

D. A pocket calendar comprising; a reduced, yearly, monthly calendar together with a weekly/daily agenda generally showing the yearly calendar on one fold, the monthly calendar on another fold plus Monday, Tuesday, Wednesday schedules on 3 reversed front folds with Thursday schedule at the back of Wednesday, Friday at the back of Tuesday, and Saturday, Sunday together at the back of Monday, or the like, folded altogether usually in accordion shape, resulting in a credit card size pocket calendar.

E. A desk calendar made of a reduced form of the type shown in B) and C), comprising; the perpetual calendar plate with its upper and lower edges connected to 2 different drums, joined together through their central shafts by means of 2 opposite plates or the like, allowing the rollers to move in one direction or the other, unrolling with them, the calendar plate to show the upper or lower sections of the said calendar.

The said rollers would have larger rims at the opposite sides to prevent the calendar plate from touching the supporting board.

F. A desk calendar using the same calendar plate described in E) rolled on a single spring loaded drum, mounted on a solid writing board generally displaying at first sight the schedule of the current day, and to check any other date or to write additional notes, the calendar plate is pulled out along the writing pad, checked and then released in an operation similar to pulling or releasing regular window blinds.

The so described calendars shown in FIG. 2 are usually made durable using:

A. Double coated light colored cardboard, plastic board or the like.

B. A front surface laminated with waterproof transparent film, mylar film or the like, or covered with waterproof transparent reusable film, or with transparent disposable papers, etc., to allow the user to write notes anywhere over the calendar and wipe them out with water or, in the case of detachable papers, to store the notes away for further references.

C. The strips containing the weekdays are generally made of non-stretchable films, synthetic papers, tyvec, polyart 2, or the like, to resist handling and pulling through the calendar life.

At the same time, the opposite ends of the said strips, are generally joined to each other at the back of the calendar plate by means of double sticking tapes, snaps or the like, to form continuous belts which are also fastened to the calendar plate to prevent the lateral movement of the weekdays with respect to the dates of the months.

D. To facilitate the reading of the calendar by anybody regardless of their languages provided they know the numbers from 1 to 10:

I. The weekdays are numbered from 1 to 7 beginning with Sunday as No. 1 and ending with Saturday as No. 7, in the same way as they are referred to in the Bible and in the old languages.

II. The twelve months of the year are also numbered from 1 to 12 beginning with January as No. 1, and ending with December as No. 12.

Figure 3:
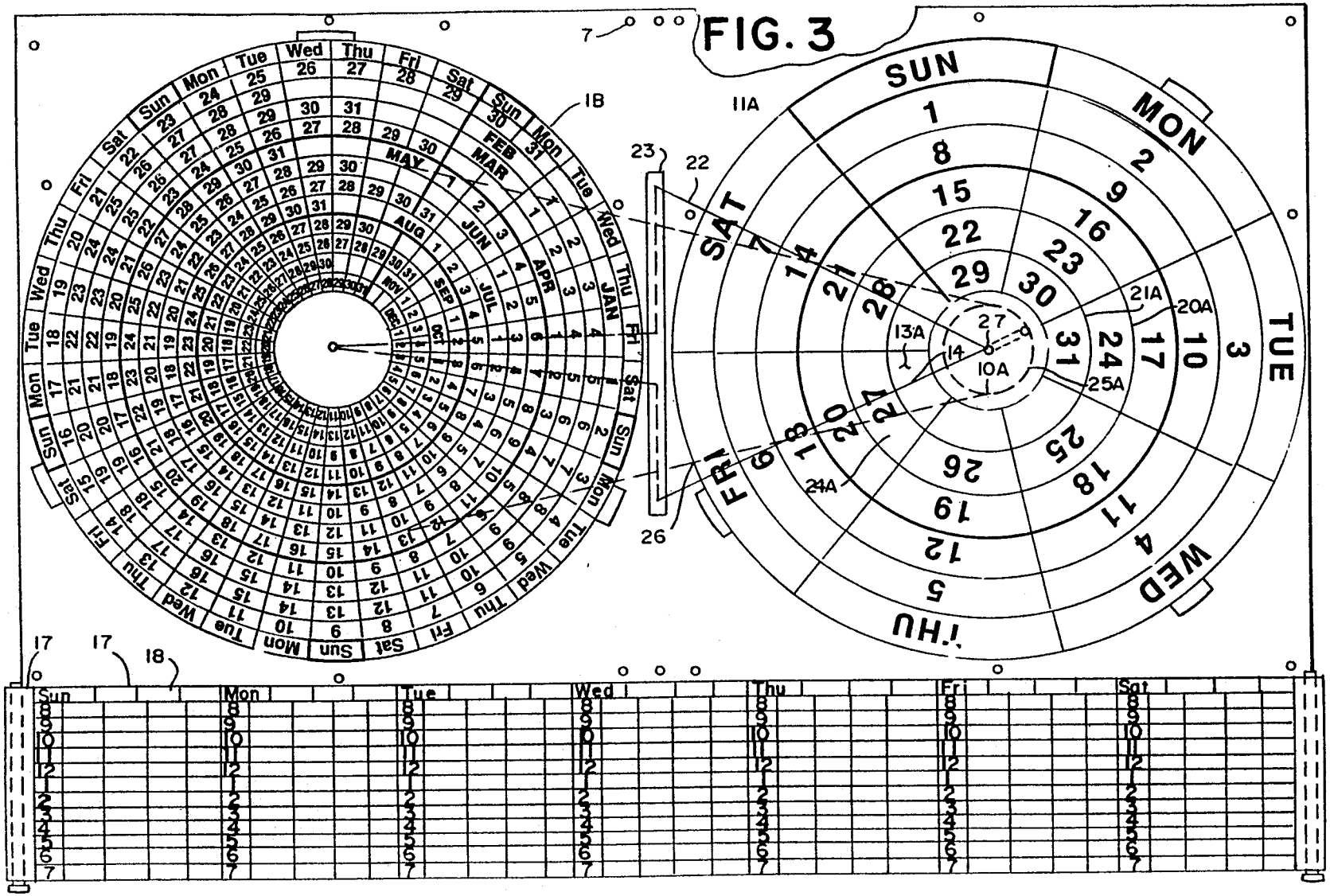
FIG. 3 —Shows a circular multi perpetual calendar; a yearly, a monthly and a weekly/daily agenda.
Figure 3A:
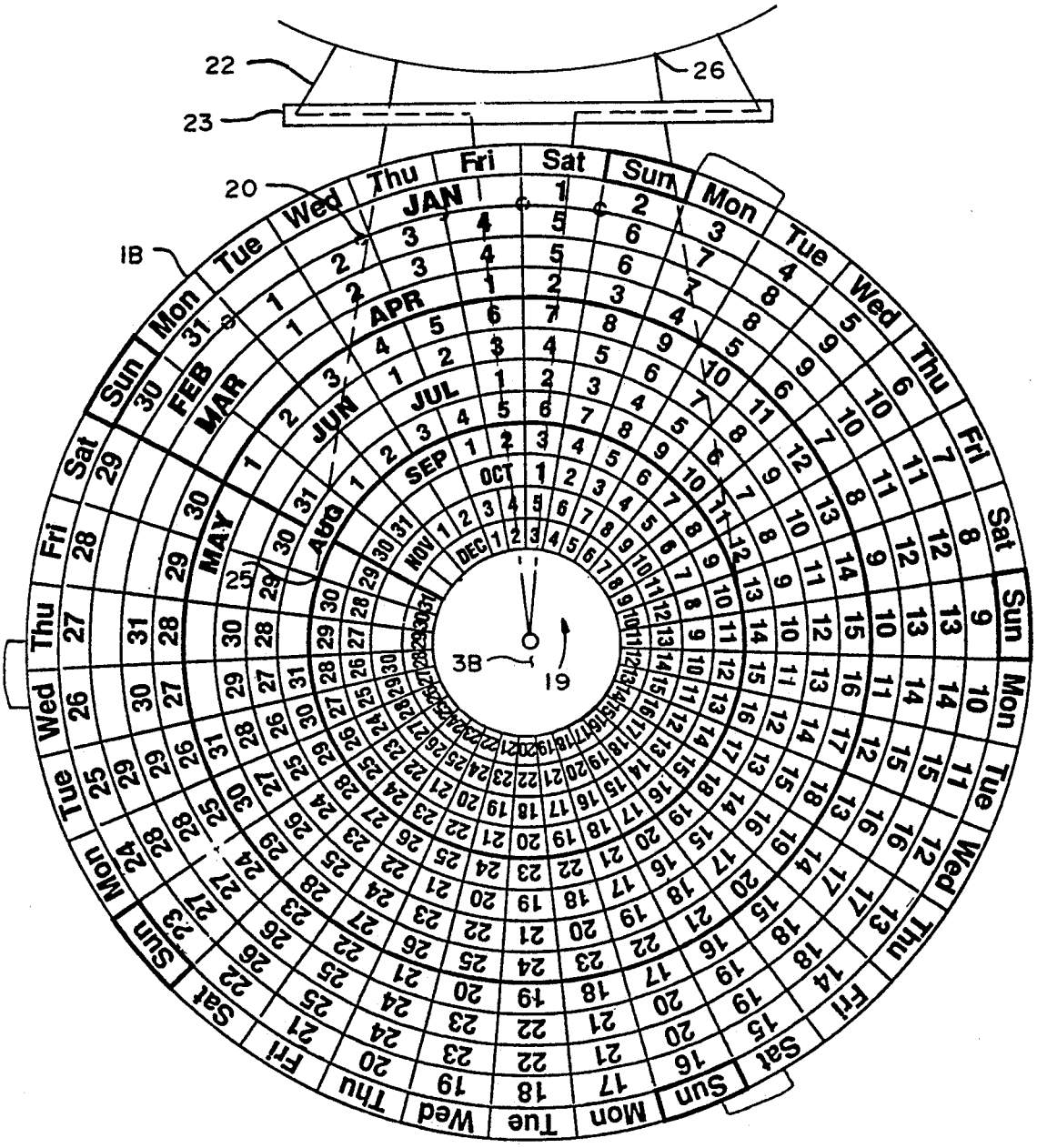
FIG. 3A —Shows an enlarged scale of the circular yearly calendar shown on FIG. 3.
Figure 3B:
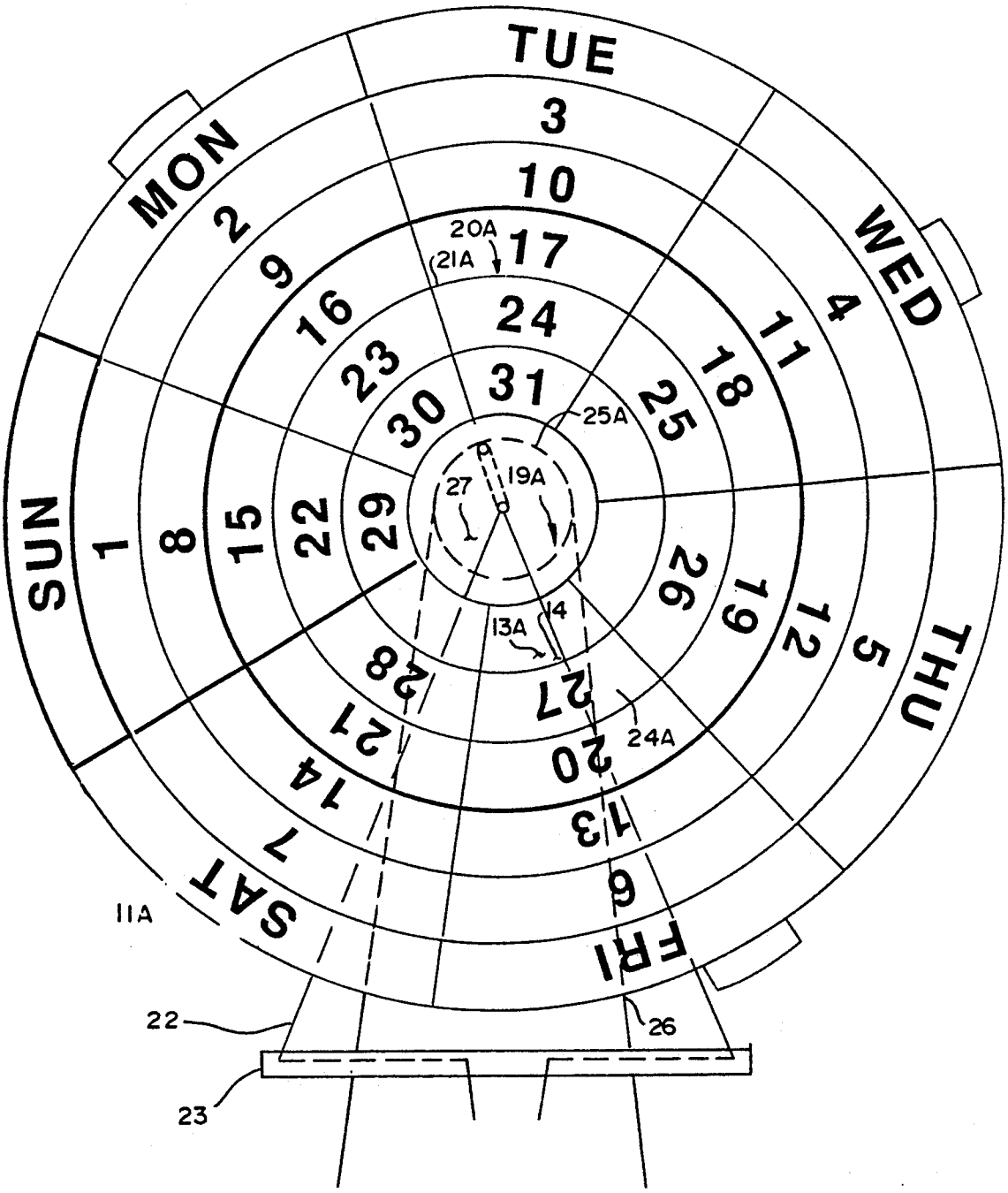
FIG. 3B —Shows an enlarged scale of the circular monthly calendar shown on FIG. 3.

See FIG. 3 —FIG. 3 shows:

A circular disc or ring like No. 1*c*, having a minimum of 35 consecutive weekdays occupying 35 equal divisions on the periphery of the said disc filling the 360 degrees of the circle.

A smaller circular disc or ring, like No. 3*c*, having the 12 months of the year placed in their constant relation with respect to the weekdays, on 12 concentric rows, divided, each of which with a number of divisions equal to the number of days in the months it represents, with each division occupying the same number of degrees occupied by a weekday division.

The discs 1*c*, 3*c*, are pivoted around a central pin No. 19, and are fixed to each other by pressure from the central pin, or by means of an eccentric short pin No. 21, or the like passing through corresponding holes No. 20.

The joining pin No. 21 has a protruding edge at its base and the holes No. 20, are cut to accommodate said edge so that by inserting the said pin and rotating it, the said protruding edge would prevent the pin from falling down.

To reset the calendar each year:

A. For years where the number of days in the month is the same as in the previous year, the pin No. 21 is taken out and one of the discs is rotated to have the 1st of January come in line with the weekday on which it begins and the remaining 11 months would automatically fall in place with regard to the weekdays.

B. For years where the number of days in one month or more is different from the previous year, and in the Gregorian calendar, for the leap years, the same operation described in (A) has to be repeated at the end of February, to have the 1st of March come in line with the weekday on which it begins and the remaining 9 months would automatically fall in place.

To show the monthly calendar at a large scale, the present calendar shows an additional similar circular monthly calendar comprising:

A. A disc or ring No. 11*a* having 7 consecutive weekdays occupying 7 equal divisions filling the 360 degrees of the circle, around the periphery of the said disc.

B. A smaller disc or ring No. 13*a*, having 31 numbers occupying 31 divisions, each of which occupies 360 degrees divided by 7, placed in 5 concentric rows; 7 divisions on each of the outer 4 rings and 3 divisions at the beginning of the innermost ring, or the like.

The numbers are arbitrarily aligned 1 to 7 on the first row, 8 to 14 on the second row, 15 to 21 on the third row, 22 to 28 on the 4th row, and 29 to 31 on the 5th row. This setting, places the numbers 1, 8, 15, 22, 29, all in line with Sunday for example.

The discs 11*a* and 13*a*, are provided with corresponding holes No. 20*a* and a pin No. 21*a*, used to fasten the discs to each other as already described for the discs 1*c* and 3*c*.

To set the monthly calendar the pin 21*a* is removed and one of the discs is rotated to have the first of the new month come in line with the weekday on which it begins, and the remaining 31 days would automatically fall in place with respect to the weekdays, then the pin 21*a* is put back in place to fasten the two discs together for the month.

To pinpoint the actual day and its date on each of the calendars, the central pins of the two calendars, No. 19, No. 19*a*, are joined with a cord made in the form of a belt to be used as a double triangular cursor, like No. 22.

The two arms of said belt are separated and passed through a multi holes tubular section, like No. 23, or the like, that separates them; a) on the yearly calendar, by 360 degrees over thirty five and b) on the monthly calendar by 360 degrees over seven. This allows to show one weekday sector on the yearly calendar and a corresponding larger sector on the monthly calendar.

The said cursor is provided at its opposite sides with slotted plates or the like, like No. 24, 24*a*, sliding along the arms of the said cursor to indicate the current date.

Everyday the yearly calendar is rotated by 360 degrees over thirty five to show the following day in between the arms of the said cursor on the yearly calendar and its date underlined by the indicator No. 24 positioned under the row representing the current month.

At the same time, the same double cursor shows on the faster rotating monthly calendar, the weekday in between the arms of the said cursor and its date underlined by the indicator No. 24*a*.

To provide space for short notes, appointments or the like, the large scale disc No. 13*a* showing the 31 days of the month is laminated with a waterproof film or provided with slots and indentations to hold circular transparent papers like No. 14*a*, cut in a circular shape and placed over the said disc to be used for writing notes and appointments on the transparent paper, guided by the daily divisions shown under the transparent paper, said paper could be replaced once a month or it could be made of permanent laminated waterproof transparent paper, mylar or the like that could be erased at the end of the month and made available for the following month.

To make it easy to operate, the dual calendar is provided with a pulley No. 25 on the yearly calendar and a smaller pulley No. 25*a* on the monthly calendar which pulleys are operated by different means, like:

A. By joining the pulleys with a belt like No. 26 to transfer the movement from one to the other and a crank like No. 27 is mounted at the center of one of the pulleys for the operation of the calendar as a whole.

B. By means of chains and sprockets.

C. By means of a chain or cable wrapped around the opposite pulleys with counter weights at their opposite ends hanging down from the said pulleys.

The pulleys are proportioned so that one pulley turns 360 degrees over seven, while the other one turns 360 degrees over thirty five, to have both calendars rotate by one weekday division each, with a simple turning of the crank.

Said pulleys are made idle for adjustment when needed.

In addition, the calendar is provided with a weekly/-daily planner as described for FIG. 2, and with holding means to display the current weekday at a large scale one weekday and its date using the One Letter Alphabet (OLA) system.

Figure 4:
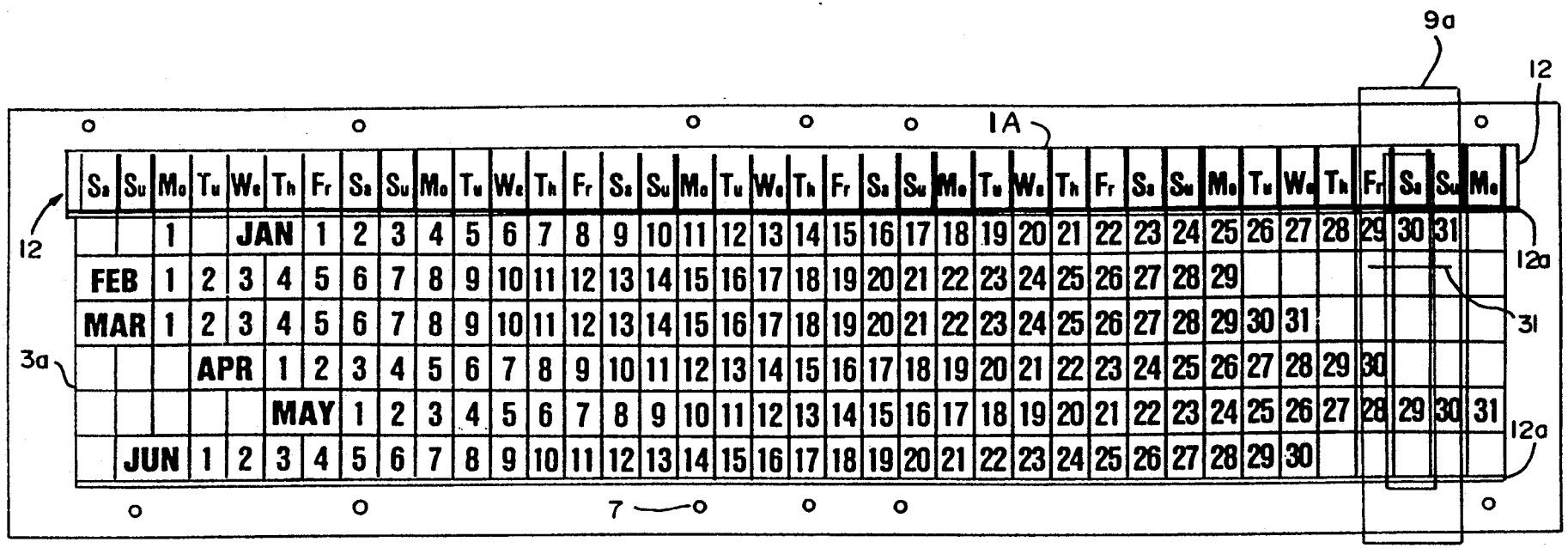
FIG. 4 —Shows a perpetual pocket calendar made of two continuous belts.

See FIG. 4 —FIG. 4 shows:

A strip No. 1*a* the same as described on FIG. 2.

A section No. 3*c* made in the same way as section 3*a* described on FIG. 2 with the difference that the section 3*c* is made in the form of a belt folded around a board, chassis or the like, like No. 28 and passed through slots like No. 12*a* where it could be rotated to bring the current month to be closer to the weekdays strip for better identification of each day and its date.

At the same time, this reduces the overall size of the calendar, which makes it well suitable for a pocket calendar.

Figure 5:
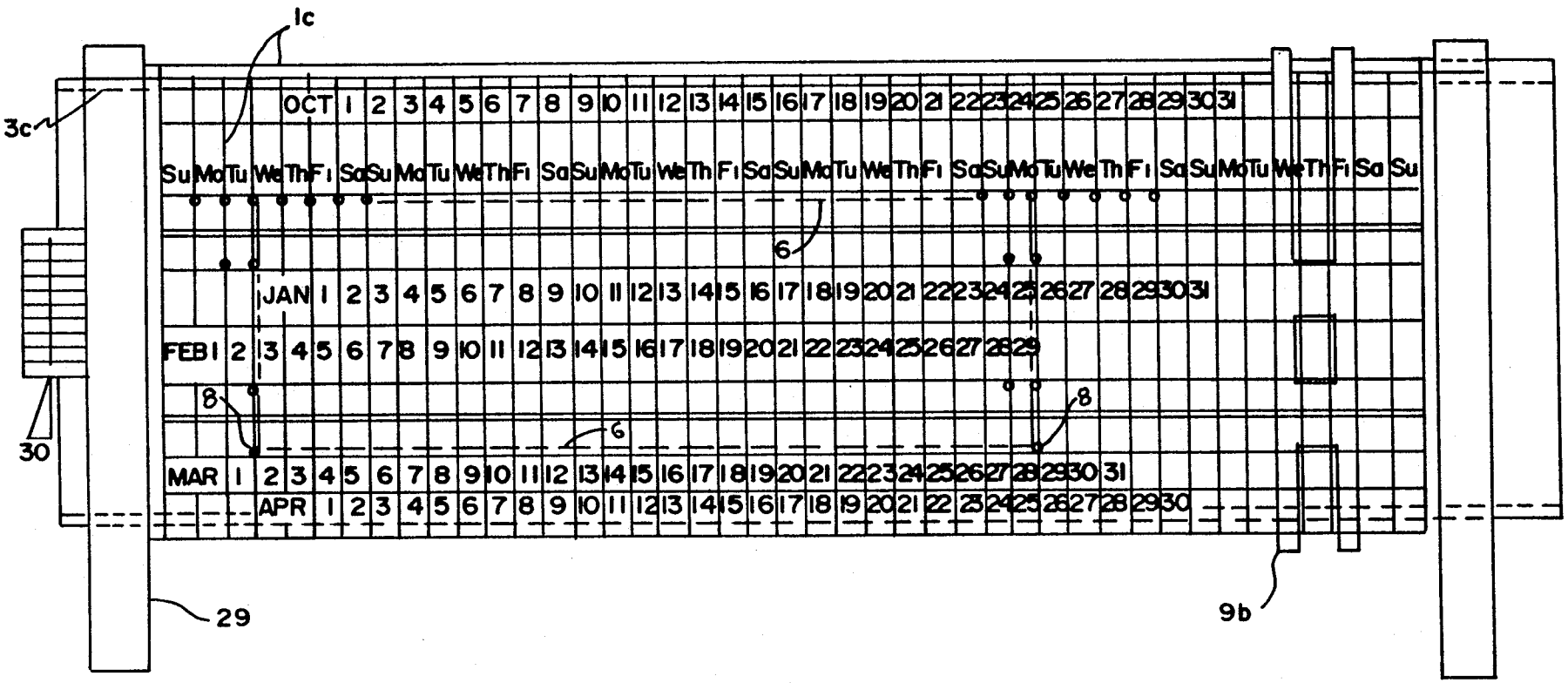
FIG. 5 —Shows a perpetual tubular calendar made of concentric transparent tubes.

See FIG. 5 —FIG. 5 shows:

A perpetual calendar comprising a minimum of 2 concentric, tubular, transparent sections:

A. An outer tubular section No. 1*c* having 43 consecutive weekdays occupying 43 equal divisions.

B. An internal transparent tube No. 3*c* having the 12 consecutive months of the year placed in parallel rows in the same way described on FIG. 2 with a difference that on FIG. 5 the rows follow the curvature of the tubular section.

The tubular sections are supported by a chassis like No. 29 and are provided with a knob like No. 30 to allow the rotation of one tube with respect to the other to keep the current month always close to the weekdays strip.

At the same time, the tubular sections have a mechanism allowing them to move parallel to each other for the yearly adjustment of the calendar.

The tubular calendar is provided with a cursor No. 31, in the form of a sleeve with a window, around the outer tubular section. Said cursor is slid once a day to show the new day and its date.

I claim:

1. A perpetual yearly calendar comprising a first part and a second part, said first part and said second part are parallel to each other, said first part and said second part are movable with respect to one another, said first part and said second part are sub-divided into equal and alignable divisions, said first part comprising an elongated strip having a plurality of equidistant transversial lines, disposed on the said strip, defining equal transversial first divisions, carrying identifications of consecutive weekdays, the number of said consecutive weekdays, is equal at least to the number of days in the longest month in a given calendar system plus twelve, occupying an equal number of the said first divisions, said second part having a surface area containing inscriptions thereon, said second part comprising a grid having a plurality of equidistant vertical lines, spaced by the same spacing as the said transversial lines, and equidistant horizontal lines, intersecting one another to define second equal divisions, corresponding to and alignable with the said first divisions, distributed into twelve rows, representing the twelve months of the year and a number of columns equal to at least the number of days in the longest month in a given calendar system plus six, each row carrying numerals in consecutive order, representative of the number of days in a given month, occupying an equal number of the said second divisions, the twelve months of the year are positioned on the said grid in their constant relation with each other, with respect to the weekdays' sequences, i.e. the first numeral of each of the twelve rows, appearing in a division of a given column, which corresponds to its constant position with respect to the other first numerals as determined by the weekdays' sequences when changing from one month to the next one, resulting in a twelve months' table, so constructed and arranged, that by aligning any date shown on the twelve months' table, with its corresponding weekday shown on the said flexible strip, the remaining 364 days of the year shown on the twelve months' table, would be automatically aligned with their corresponding weekdays shown on the said flexible strip.

2. A perpetual calendar as in claim 1, wherein the first part and the second part comprise 2 concentric transparent tubes, one tube showing the first part and the other showing the second part, with a provision to rotate the said concentric tubular sections with respect to one another, and with a provision to move the saids tubular sections laterally with respect to one another for adjustment.

3. A perpetual calendar as claimed in claim 1 wherein said first part comprises a band, showing the weekdays, whose ends are foldable behind said second part as the opposite sides of the said column divisions, said band is extended and joined end-to-end with known methods at the back of the unit to form a continuous belt, said first part shows the consecutive weekdays, accompanied with serial numbers, 1 to 7, generally allocating numbers: 1 for Sunday, up to 7 for Saturday, the resulting calendar is accompanied with a permanent Agenda, comprising a plurality of columns headed with the seven consecutive weekdays, said columns have provisions to show the consecutive hours of the day, with a margin to mark the appointments, hour by hour on each column.

4. A perpetual dual calendar as claimed in claim 3, having in addition a perpetual monthly calendar, comprising a first part and a second part, said first part and said second part being movable with respect to one another, said first part and said second part are subdivided into equal and alignable divisions, said first part comprising an elongated strip having a plurality of equidistant transversial lines, disposed on the said strip, defining equal transversial first divisions, carrying identifications of consecutive weekdays, the number of said weekdays, is equal to at least one full week plus 6 days, or 13 consecutive weekdays, occupying an equal number of the said first divisions, said second part having a surface area containing inscriptions thereon, said second part comprising a grid having a plurality of equidistant vertical lines, spaced by the same spacing as the said transversial lines, and equidistant horizontal lines, intersecting one another to define equal second divisions, corresponding to and alignable with the said first divisions, distributed into at least 5 rows and 7 column divisions representing 4 full weeks and a balance of 3 weekdays, each row carrying numerals in consecutive order representing dates of a given week, generally positioned 1 to 7 on a first row, 8 to 14 on a second row, 15 to 21 on a third row, 22 to 28 on a fourth row, 29, 30, 31, on a fifth row, resulting with numbers: 1, 8, 15, 22, 29, occupying the first division on each row and aligned with a first weekday shown on the said first part, and numbers, 7, 14, 21, 28, occupying the seventh division on each row and aligned with a seventh weekday shown on the said first part, resulting in a monthly table, so constructed and arranged, that by aligning any date shown on the said monthly table, with its corresponding weekday shown on the said first part, all the remaining dates of the month in question would be automatically aligned with their corresponding weekdays shown on the said first part, the resulting calendar is also combined with an appointment table, comprising a plurality of spaces identified with alphabetic letters, an appointment is marked with an alphabetic letter on the said second divisions which carry the appointment date on the yearly calendar and is described in detail beside the corresponding letter on the appointment table, the surface of the calendar is laminated with a transparent waterproof film or the like to allow repeated writing on the said surface, the first part, showing the weekdays, on the so described calendars, are made of non-stretchable, flexible material, like polyester, mylar, vinyl, thivac, paper, cloth or the like, and the second parts showing the 12 months' table, the one month's table, the Agenda, etc are made of cardboard, plastic, vinyl, or the like, the different parts of the combined, perpetual calendar/Agenda; the yearly calendar, the monthly calendar, the permanent Agenda, etc, are placed in different positions with respect to each other as the necessity requires.

5. A perpetual dual calendar as in claim 4, comprising a flat board provided with sets of holding points, positioned at the main intersections of the lines of superimposed common symbols, representing the alphanumeric characters, each set of the said holding points comprises at least 9 holding points, defining 3 parallel rows and 3 columns, coloured and different shaped displaying means are spaced inbetween the said holding points, to show the first letter of the actual weekday in one colour and its date in another colour and shape, displayed at the full height and width of the said flat board, allowing distant visual reading as well as reading by touching process, a cursor comprising a string, suspended from a holder, sliding along the top edge of the said flat board, said string holds movable beads to pin point the actual weekday and its date.

6. A perpetual lunar calendar as in claim 3, wherein the 12 months of the year are shown on movable flexible bands, the number of the said flexible bands is generally equal to the number of the variable months in the year plus 1, said flexible bands are folded at the opposite ends of the said vertical columns, extended and joined end-to-end at the back of the supporting unit, to form a continuous belt.

7. A dual perpetual calendar as in claim 3, combining a solar calendar and a shorter lunar calendar, the said rows showing the solar calendar on the said second part are spaced from each other with blank spaces left inbetween, the lunar months are shown on 12 flexible bands, said flexible bands are positioned in the blank spaces left inbetween the said rows showing the solar months, each of the said flexible bands shows a plurality of consecutive lunar months, each of the said flexible bands is provided with means to change the name of the month it represents, from one year to the other, said flexible bands are interchangeable inbetween each other, said flexible bands are folded behind the supporting board and joined end-to-end to form continuous belts, the different parts of the joint calendar; the solar calendar and the lunar calendar, could be placed in different positions with respect to each other as the necessity requires.

8. A perpetual calendar as in claim 3, wherein the second part is shown on a mobile belt rotatable in a perpendicular direction to the belt forming the first part.

9. A perpetual calendar as in claim 1, wherein said second part is divided into 2 sections, a first section showing 2 rows representing January and February, and a second section showing the remaining 10 months of the year, from March to December, to allow direct adjustment of the months vis-a-vis the weekdays in leap years.

10. A perpetual circular yearly calendar comprising a first part and a second part, said first part and said second part being coaxial, movable with respect to one another, and with interlocking means, said first part and said second part are sub-divided into alignable divisions, of equal angular measurements said first part comprises a circular ring sub-divided with a plurality of equidistant first radiusus around the 360 degrees circumference to define an annular distribution of equal first divisions, said first divisions carrying identifications of consecutive weekdays, the number of said weekdays is equal to at least the number of full weeks, i.e. the number divisible by seven that would encompass the longest month in a given calendar system, the resulting number of said weekdays occupy an equal number of said first divisions, said second part having a grid of equidistant second radiusus, spaced by the same angular spacing as the said first radiusus, and equidistant concentric circumference intersecting one another to define equal second divisions, corresponding to and alignable with the said first divisions, distributed in 12 concentric rings representing the 12 months of the year and at least 35 sector divisions, said sector divisions occupy the same number of degrees as, and are alignable with the said first divisions, each of the 12 rings carrying numerals in consecutive order representative of the number of days in a given month, occupying an equal number of the said second divisions, the 12 months of the year are placed in consecutive order on the said 12 consecutive rings, and are positioned in their constant relation with each other with respect to the weekdays' sequences, i.e. the first numeral in each of the 12 rings, appearing in a division of a given sector, which corresponds to its constant position with respect to the other first numerals as determined by the weekdays' sequences when changing from one month to the next one, resulting in a 12 months' table, so constructed and, arranged that by aligning any date shown on the said 12 months' table, with its corresponding weekday shown on the said first part, the remaining 364 days of the year shown on the 12 months' table, would be automatically aligned with their corresponding weekdays shown on the said first part.

11. A perpetual, circular yearly calendar as claimed in claim 10, combined with a monthly circular calendar, comprising a first part and a second part, said first part and said second part being coaxial, movable with respect to one another, and with interlocking means, said first part and said second part are sub-divided into alignable divisions of equal angular measurements, said first part comprises a circular ring sub-divided with a plurality of equidistant first radiusus around the 360 degrees circumference to define an annular distribution of equal first divisions, said first divisions carrying identifications of consecutive weekdays the number of said weekdays is equal to at least one full week or 7 consecutive weekdays, occupying an equal number of the said first divisions, said second part having a grid of equidistant second radiusus, spaced by the same angular spacing as the said first radiusus, and equidistant concentric circumferences intersecting one another to define equal second divisions, corresponding to and alignable with the said first divisions, distributed into at least 5 concentric rings and 7 sector divisions, representing 4 full weeks and a balance of 3 weekdays, each ring carrying numerals in consecutive order representing dates of a given week, generally positioned 1 to 7 on a first ring, 8 to 14 on a second ring, 15 to 21 on a third ring, 22 to 28 on a fourth ring, 29, 30, 31, on a fifth ring, resulting with numbers 1, 8, 15, 22, 29, occupying a first division on each ring and aligned with a first weekday shown on the said first part, and numbers 7, 14, 21, 28, occupying a seventh division on each ring and aligned with a seventh weekday shown on the said first part, resulting in a monthly circular table, so constructed and arranged that by aligning any date shown on the said monthly table, with its corresponding weekday shown on the said first part, all the remaining dates of the month in question, would be automatically aligned with their corresponding weekdays shown on the said first part, the different parts of the combined calendar; the yearly calendar, the monthly calendar, etc, are placed in different positions with respect to each other as the necessity requires.

12. A combined perpetual circular calendar as in claim 11, comprising a circular yearly calendar and a circular monthly calendar, provided with proportional pulleys on each calendar with the ratio 7 to 35, and with belt transmission inbetween the 2 pulleys, allowing the monthly calendar to rotate 5 turns for every single turn of the yearly calendar, a rotation of the monthly calendar by 360 degrees over 7 each day, would rotate the yearly calendar 360 degrees over 35 with the same single movement of either calendar, a common cursor made of an elastic belt joining the centers of the 2 calendars and spaced with a common spacer that would open the said flexible cursor by an angle of 360 degrees over 35 on the yearly calendar and by an angle of 360 degrees over 7 on the monthly calendar, both the date on the monthly calendar and the date on the yearly calendar, would be seen opposite to each other at tangent first divisions on the 2 opposite calendars inbetween the strings of the said flexible cursor.

13. A dual perpetual circular calendar as in claim 10, combining a solar calendar, with a shorter lunar calendar, using; a) for the solar calendar, 2 discs as described in claim 10, with open spaces inbetween the rings representing the 12 months of the solar calendar; b) for the lunar calendar, 12 superimposed, transparent discs, each of the said transparent discs shows one month of the lunar year positioned opposite one of the blank spaces left inbetween the rings showing the solar months, the rings showing the lunar months, are printed with numbers representing consecutive months to fill the 35 divisions on each ring, both the solar calendar discs, and the lunar calendar discs are coaxial with each other, the solar calendar discs and the lunar calendar discs, are sub-divided into divisions measuring 360 degrees divided by 35 divisions each, the lunar discs are provided with means to change the name of the month on each disc from one year to the other.

14. A perpetual circular yearly lunar calendar as in claim 10, wherein the second part comprises 12 individual discs or rings, showing the said 12 months' table, said 12 discs are coaxial with the said first part showing the weekdays, all the discs of the calendar are coaxial, rotatable with respect to each other and with interlocking means to hold them together at a required position.

15. A perpetual monthly calendar comprising a first part and a second part, said first part and said second part are parallel to each other, said first part and said second part are movable with respect to one another, said first part and said second part are sub-divided into equal and alignable divisions, said first part comprising an elongated strip having a plurality of equidistant transversial lines, disposed on the said strip, defining equal transversial divisions, carrying identifications of consecutive weekdays, the number of said consecutive weekdays is equal to at least one full week plus six days or thirteen consecutive weekdays, occupying an equal number of the said first divisions, said second part having a surface area containing inscriptions thereon, said second part comprising a grid having a plurality of equidistant vertical lines, spaced by the same spacing as the said transversial lines, and equidistant horizontal lines, intersecting one another to define equal second divisions, corresponding to and alignable with the said first divisions, distributed into at least five rows and seven column divisions representing four full weeks and a balance of three weekdays, each row carrying numerals in consecutive order representing dates of a given week, generally positioned 1 to 7 on a first row, 8 to 14 on a second row, 15 to 21 on a third row, 22 to 28 on a fourth row, 29, 30, 31, on a fifth row, resulting with numbers 1, 8, 15, 22, 29, occupying the first division on each row and aligned with a first weekday shown on the said first part, and numbers 7, 14, 21, 28, occupying the seventh division on each row and aligned with a seventh weekday shown on the said first part, resulting in a monthly table, so constructed and arranged that by aligning any date shown on the said monthly table, with its corresponding weekday shown on the said first part, all the remaining dates of the month in question would be automatically aligned with their corresponding weekdays shown on the said first part.

16. A perpetual monthly calendar as in claim 15, with possibilities to begin the week with any selected weekday, wherein said first part is mounted on a general support, wherein, the divisions on the said second part are distributed into at least 6 rows, and into at least 13 column divisions shown on a long flexible band with a minimum of 7 column divisions on display at a time, each row carrying numerals in consecutive order representing dates, generally positioned 1–7 on a first row, 2–14 on a second row, 9–21 on a third row, 16–28 on a fourth row, 23–31 on a fifth row, and 30, 31, at the beginning of a sixth row, aligned in the same way described in claim 15, both ends of the said long flexible bend are folded behind the said general support, at the opposite ends of 7 divisions, alignable with 7 displayed divisions on the said first part, the opposite ends of the said long flexible band are joined end-to-end to form a continuous belt, so constructed and arranged that by setting the first part to show the required weekday at the beginning of the week, and by moving the second part to have the first of the month in line with its corresponding weekday shown on the said first part, all the remaining dates of the month shown on the said flexible band, will be automatically aligned with their corresponding weekdays shown on the said first part.

17. A perpetual circular monthly calendar comprising a first part and a second part, said first part and said second part being coaxial, movable with respect to one another, and with interlocking means, said first part and said second part are sub-divided into alignable divisions, of equal angular measurements, said first part comprises a circular ring sub-divided with a plurality of equidistant first radiusus around the 360 degrees circumference to define an annular distribution of equal first divisions, said first divisions carrying identifications of consecutive weekdays, the number of said weekdays is equal to at least one full week or 7 consecutive weekdays, occupying an equal number of the said first divisions, said second part having a grid of equidistant second radiusus, spaced by the same angular spacing as the said first radiusus, and equidistant concentric circumferences, intersecting one another to define equal second divisions, corresponding to and alignable with the said first divisions, distributed into at least 5 concentric rings and 7 sector divisions, representing 4 full weeks and a balance of 3 weekdays, each ring carrying numerals in consecutive order representing dates of a given week, generally positioned 1 to 7 on a first ring, 8 to 14 on a second ring, 15 to 21 on a third ring, 22 to 28 on a fourth ring, 29, 30, 31, on a fifth ring, resulting with numbers 1, 8, 15, 22, 29, occupying a first division on each ring and aligned with a first weekday shown on the said first part, and numbers 7, 14, 21, 28, occupying a seventh division on each ring and aligned with a seventh weekday shown on the said first part, resulting in a monthly circular table, so constructed and PBC2 arranged that by aligning any date shown on the said monthly table, with its corresponding weekday shown on the said first part, all the remaining dates of the month in question, would be automatically aligned with their corresponding weekdays shown on the said first part.

* * * * *